US005916341A

United States Patent [19]

Lin

[11] Patent Number: 5,916,341

[45] Date of Patent: Jun. 29, 1999

[54] COMBINATION SCREWDRIVER TOOL

[76] Inventor: Pi-Lien Lin, No. 38-3 Fu-Sing Road, Han-Pau Tsun, Fuang-Yuan Shang, Chang-Hua Hsien, Taiwan

[21] Appl. No.: 09/070,034

[22] Filed: Apr. 30, 1998

[51] Int. Cl.[6] ..... B25B 23/16; B25B 23/00; B25F 1/00

[52] U.S. Cl. ..... 81/437; 81/438; 81/439; 81/177.4; 81/490

[58] Field of Search ..... 81/439, 438, 437, 81/177.4, 490

[56] References Cited

U.S. PATENT DOCUMENTS 4,798,111 1/1989 Cheeseman ..... 81/124.4
5,669,492 9/1997 Chao ..... 206/234
5,799,552 9/1998 Curtis ..... 81/490

*Primary Examiner*—David A. Scherbel
*Assistant Examiner*—Philip J. Hoffmann
*Attorney, Agent, or Firm*—Harrison & Egbert

[57] ABSTRACT

A combination screwdriver is composed of a handle and a variety of screwdriver sockets and screwdriver blades having different tips, such as a slotted tip, hexagonal tip, Phillips tip. The handle has a hexagonal shank engageable with the screwdriver sockets, screwdriver blades, and a top seat for keeping the screwdriver blades. The handle is provided with a side seat fastened therewith. The side seat is intended to keep the screwdriver blades and the screwdriver sockets. The side seat has a hook engageable with a worker's waist belt.

1 Claim, 6 Drawing Sheets

COMBINATION SCREWDRIVER TOOL

FIELD OF THE INVENTION

The present invention relates generally to a hand tool, and more particularly to a combination hand tool.

BACKGROUND OF THE INVENTION

Both screwdriver and wrench are hand tools that are widely used. There are a variety of screwdrivers, such as a PHILLIPS™ screwdriver, slotted screwdriver, nut driver, etc. It is therefore rather inconvenient for a worker to carry so many different hand tools.

SUMMARY OF THE INVENTION

The primary objective of the present invention is therefore to provide a combination hand tool including a handle, and a variety of screwdriver sockets and screwdriver tips. The handle is provided with a shank fastened therewith. The shank is fastened with a top seat which is engageable with a variety of screwdriver tips and screwdriver sockets. The handle is provided with a side seat attached thereto for engaging a variety of screwdriver tips and screwdriver sockets.

The foregoing features, functions, and advantages of the present invention will be more readily understood upon a thoughtful deliberation of the following detailed description of a preferred embodiment of the present invention with reference to the accompanying drawings.

DETAILED DESCRIPTION OF THE EMBODIMENT

Figure 1:
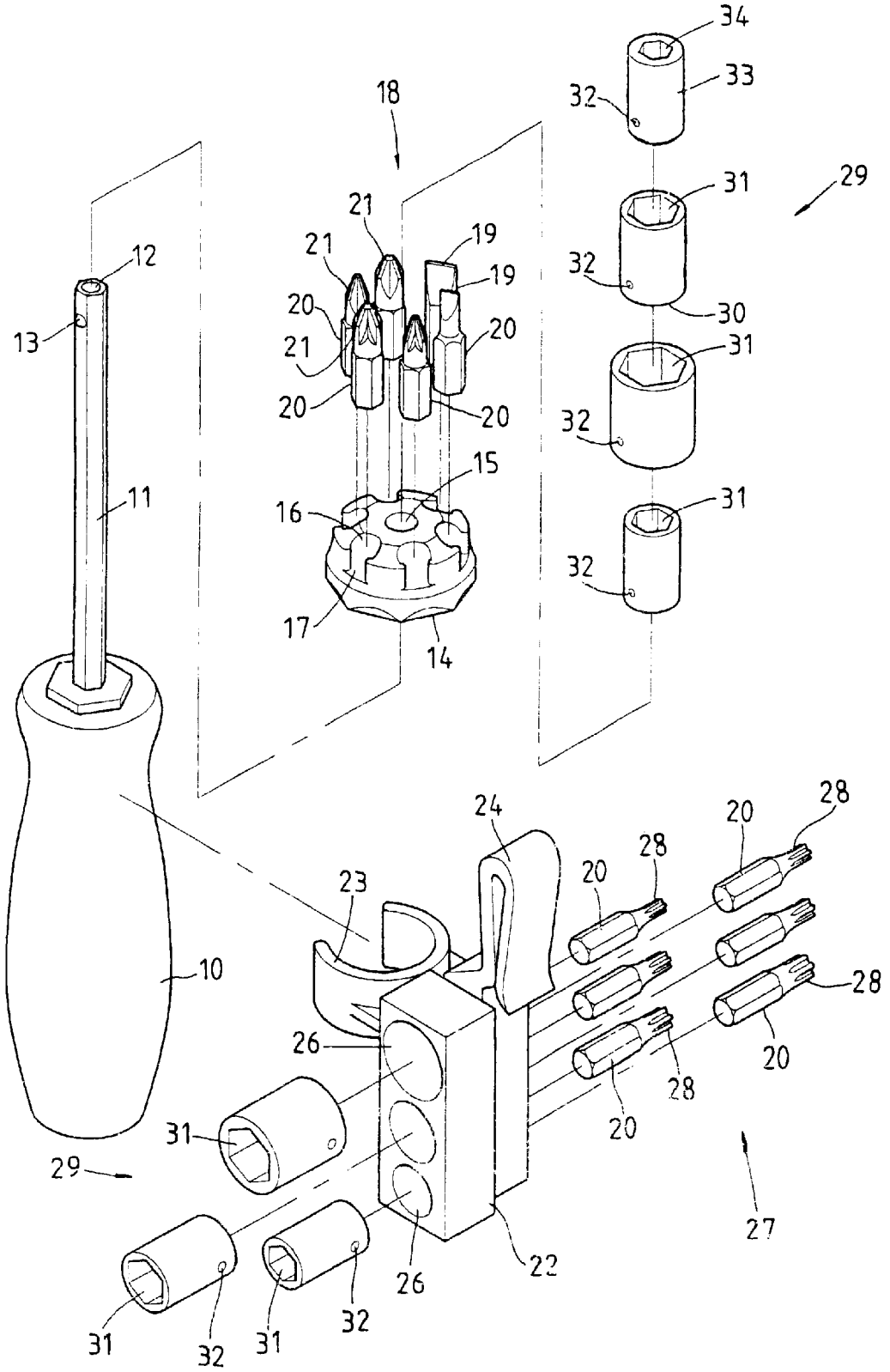
FIG. 1 shows an exploded view of a combination hand tool of the present invention.
Figure 2:
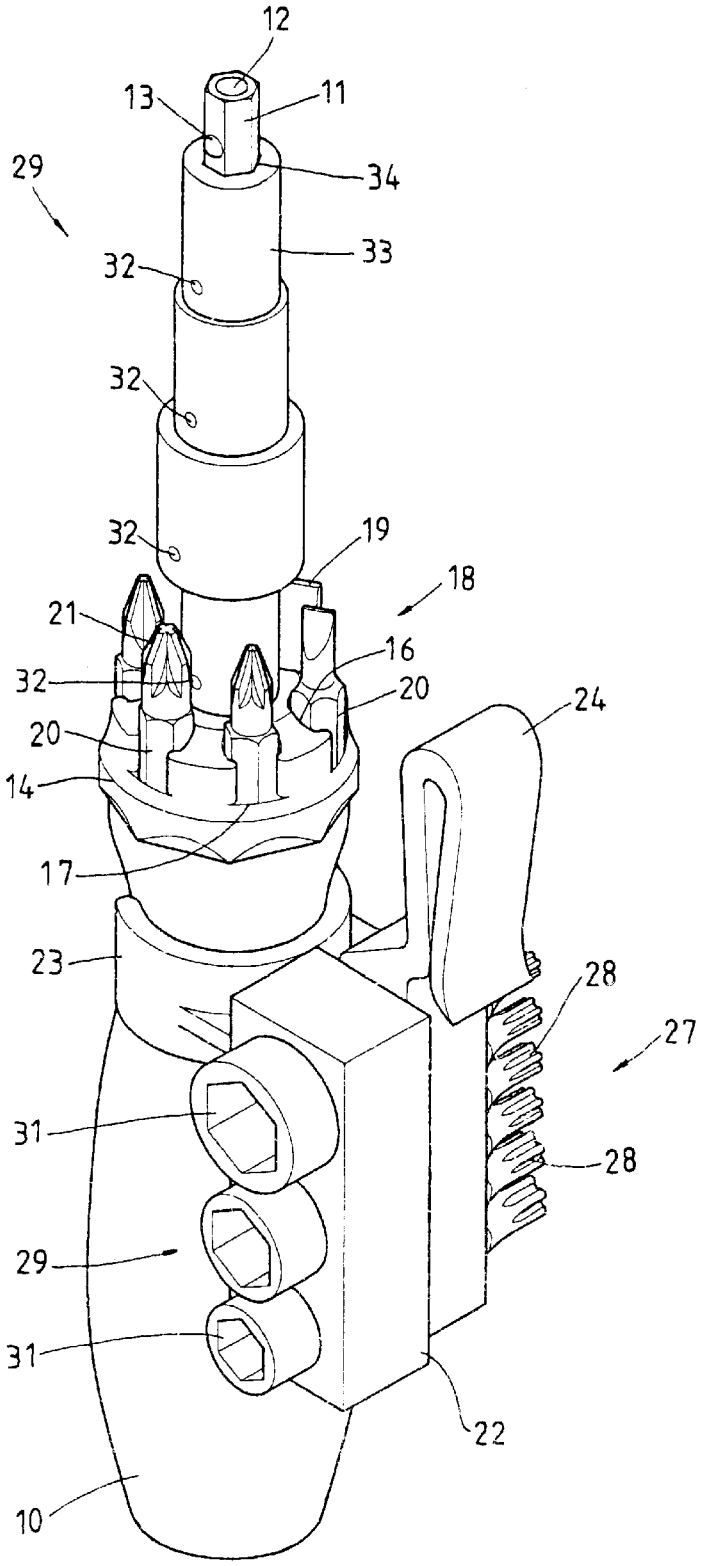
FIG. 2 shows a perspective view of the combination hand tool of the present invention in combination.

As shown in FIGS. 1 and 2, a combination hand tool embodied in the present invention is composed of the component parts, which are described hereinafter.

A handle 10 is provided with a shank 11, which is fastened at one end thereof with the handle 10 and is provided at another end thereof with a magnetic element 12 and a locating ball 13 that is embedded in the shank 11. The shank 11 has a hexagonal cross section.

A top seat 14 is provided with a center through hole 15, which is engaged with the shank 11. The top seat 14 is provided in the upper side thereof with a plurality of fitting holes 16 each having a narrow opening 17.

A plurality of screwdriver blades 18, each of which has a hexagonal end 20. The screwdriver blades 18 have a slotted tip 19 or a PHILLIPS(™) (of cruciform shape) tip 21. The hexagonal ends 20 of the screwdriver blades 18 are engageable with the fitting holes 16 of the top seat 14.

A side seat 22 is composed of a fastener 23, a hook 24, and a plurality of slots 26. The fastener 23 can be detachably fastened with the handle 10, whereas the hook 24 is engageable with a waist belt. The slots 26 are different in dimension from one another. The side seat 22 is also provided with a plurality of fitting holes 25 for holding a plurality of screwdriver blades 27, each of which has a hexagonal base 20 and a hexagonal tip 28. The slots 26 are intended to hold a plurality of screwdriver sockets 29 each having a hexagonal fitting holes 31 and a locating hole 32 engageable with the locating ball 13 of the shank 11.

Figure 3:
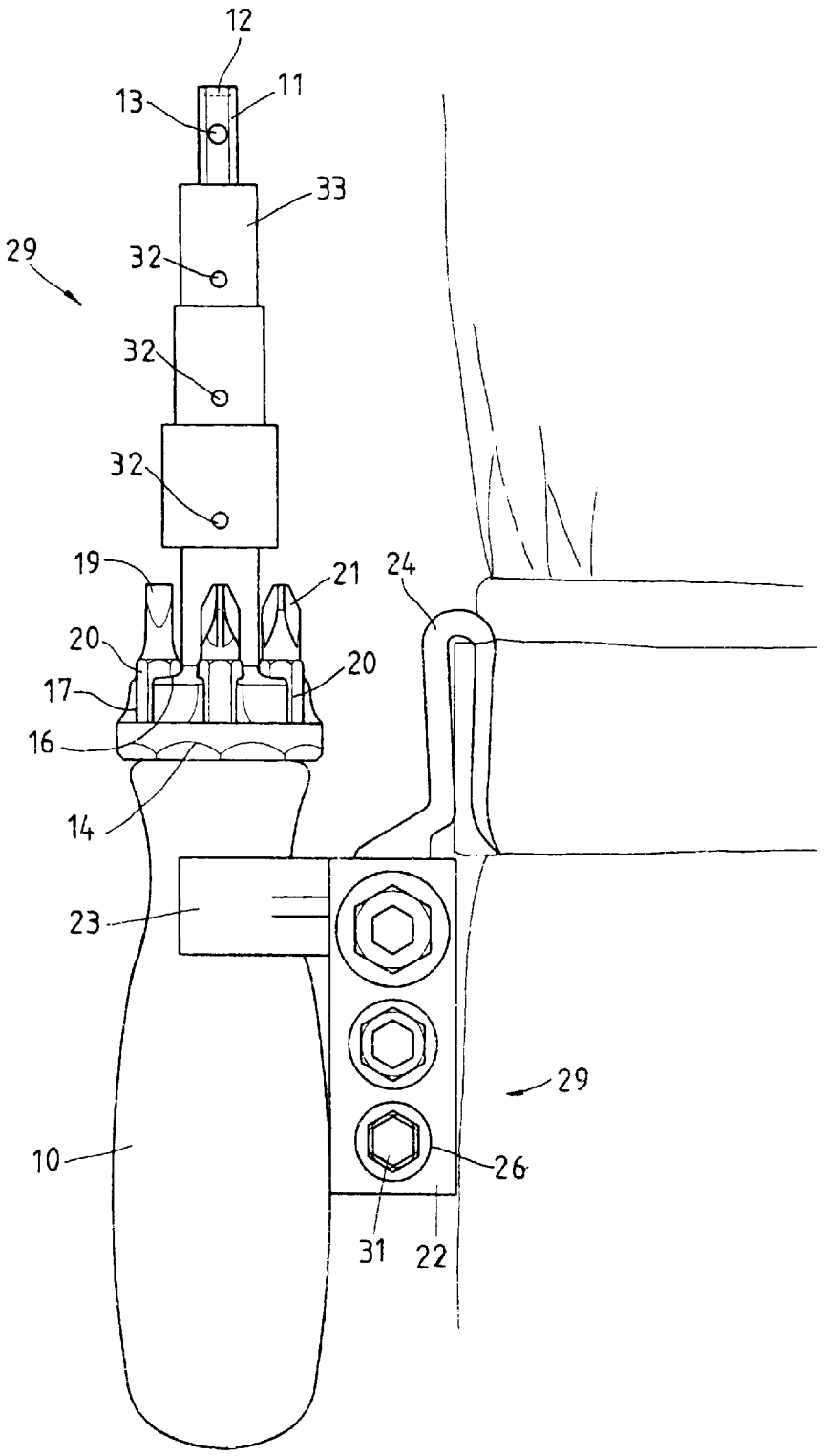
FIG. 3 shows a schematic view of the present invention being carried around by a worker.
Figure 4:
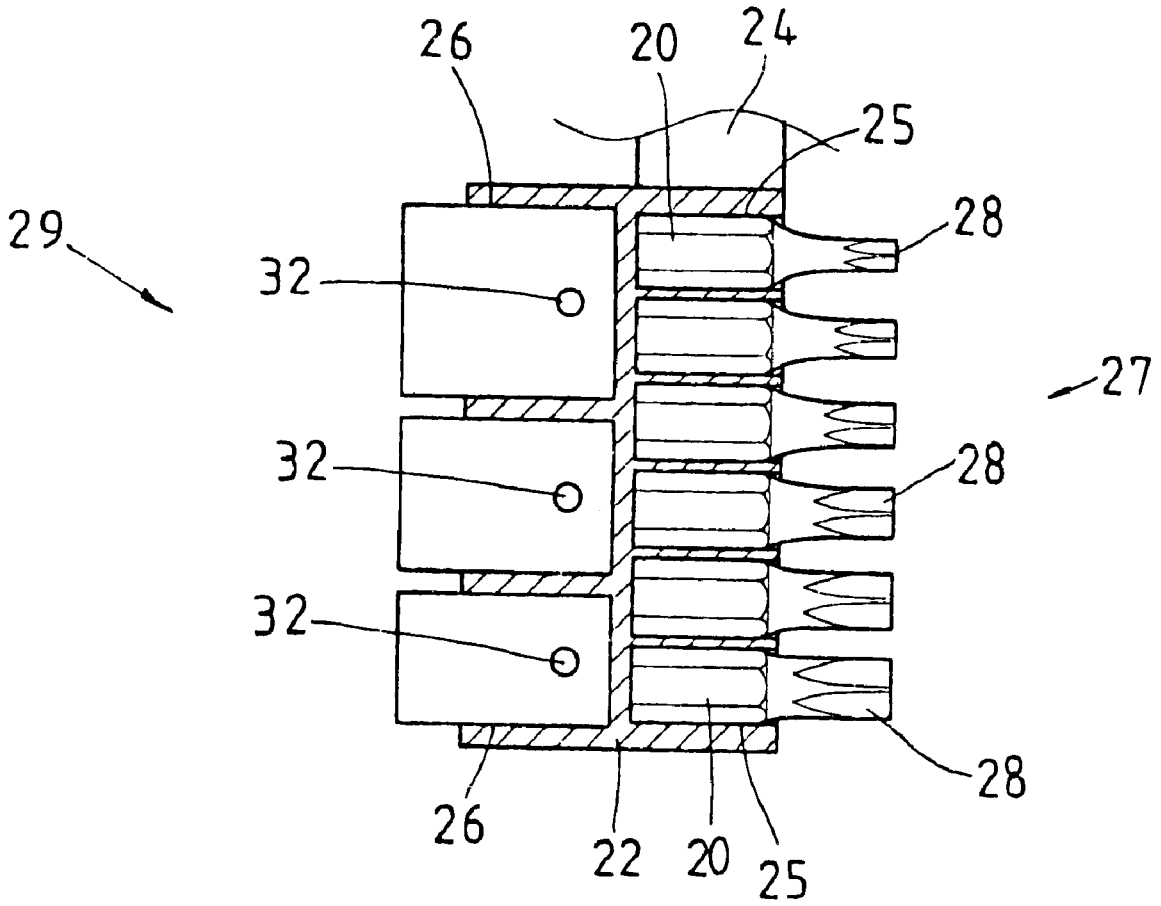
FIG. 4 shows a partial sectional view of the present invention.

In light of the side seat 22, there is no need to provide a tool box for keeping a variety of screwdriver tips and screwdriver sockets. The combination hand tool can be carried around by a worker such that the hook 24 is engaged with the waist belt of the worker, as illustrated in FIGS. 3 and 4. The fastener 23 has an opening which faces away from the side seat 22. This opening allows the handle 10 to be inserted into the fastener 23. The hook 24 has an opening through which a waist belt must pass in order to engage with the hook 24. The opening for the hook 24 faces in a direction transverse to the opening for the fastener 23.

Figure 6:
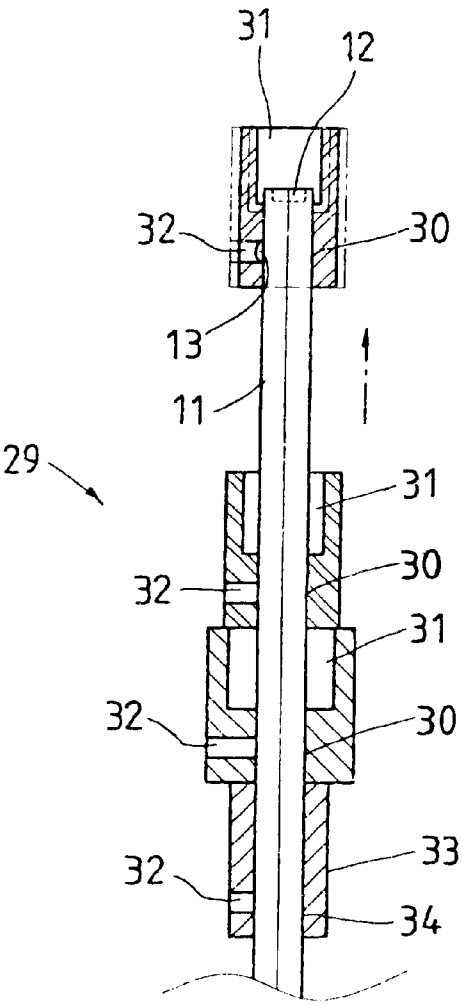
FIG. 6 shows a schematic view of the shank of the present invention in operation.
Figure 5:
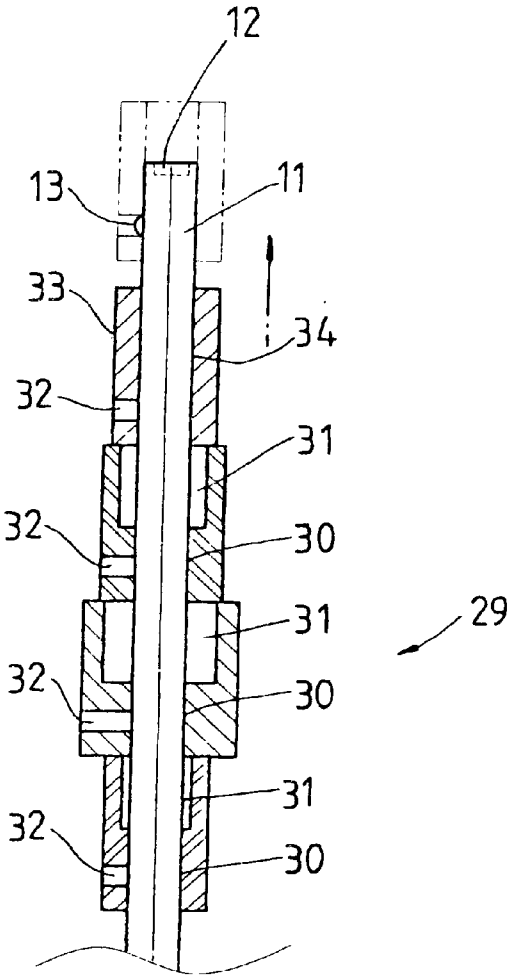
FIG. 5 shows a longitudinal sectional view of the shank of the handle of the present invention.

As illustrated in FIGS. 5 and 6, the wrench sockets 29 can be easily engaged with the shank 11 such that the locating hole 32 of the sockets 29 is engaged with the locating ball 13 of the shank 11.

Figure 8:
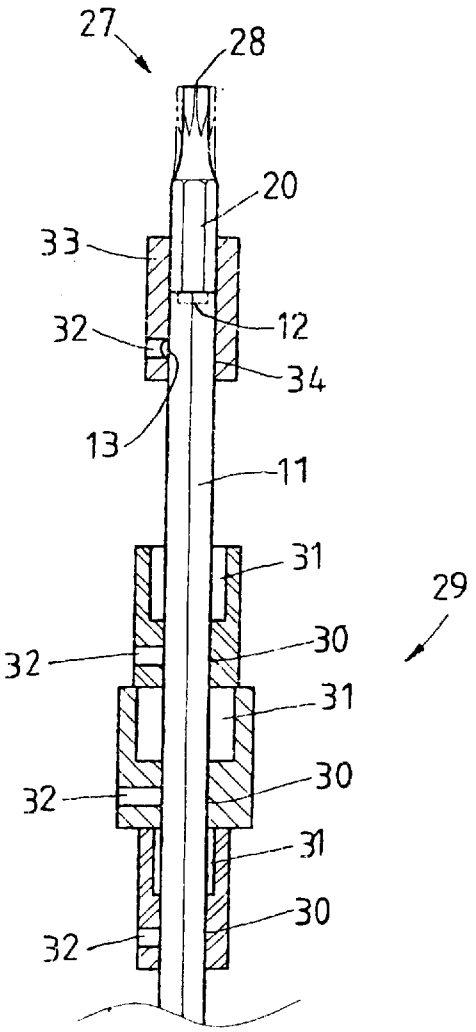
FIG. 8 shows still another schematic view of the shank of the present invention in operation.
Figure 7:
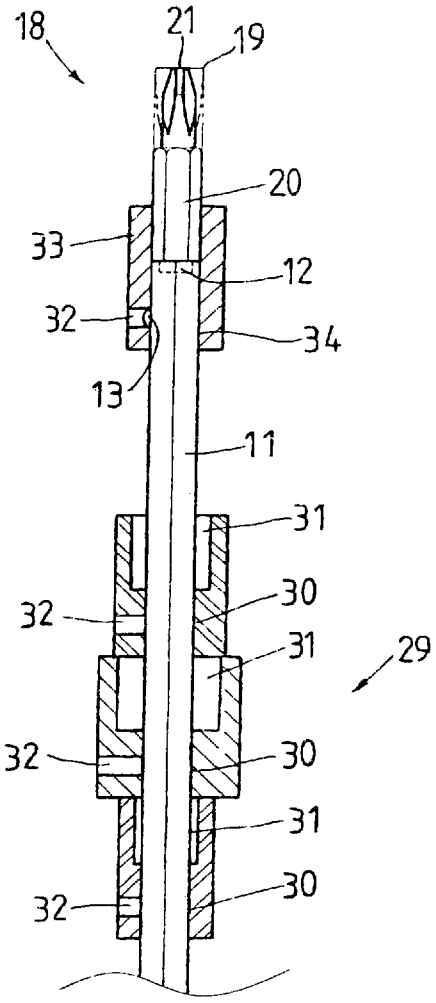
FIG. 7 shows another schematic view of the shank of the present invention in operation.

As shown in FIGS. 7 and 8, the wrench sockets 29 are engaged with the shank 11 such that the locating hole 32 of the wrench socket 29 is engaged with the locating ball 13 of the shank 11, and that the screwdriver blade 18 or 27 is engaged with the magnetic element 12 of the shank 11 via the hexagonal hole 34 of the screwdriver socket 29.

What is claimed is:

1. A combination screwdriver tool comprising:

a handle having a shank at one end thereof, said shank having a magnetic element at an end opposite said handle, said shank having a locating ball formed thereon, said shank having a hexagonal cross section;

a top seat having a fastening hole at a center thereof, said fastening hole engageable with said shank, said top seat having a plurality of fitting holes formed therein;

a side set having a fastener detachably engaged with said handle, said fastener having an opening facing away from said side seat, said handle received through said opening, said side seat having a hook adapted for engagement with a waist belt, said hook having an opening facing transverse to said opening of said fastener, said side seat having a plurality of slots of various dimensions formed therein, said side seat having a plurality of fitting holes formed therein;

a plurality of screwdriver sockets having a hexagonal through hole, said hexagonal through hole engaged with said shank such that a locating hole located in an inner wall of said hexagonal through hole is engaged with said locating ball of said shank, said plurality of screwdriver sockets being capable of being retained respectively in said plurality of slots of said side seat;

a first plurality of screwdriver blades each having a hexagonal base, said hexagonal base engageable with said magnetic element of said shank, said first plurality of screwdriver blades further having a slotted tip or a cruciform tip, said hexagonal base of said first plurality of screwdriver blades capable of being retained in a respective fitting hole of said plurality of fitting holes of said top seat; and a second plurality of screwdriver blades each having a hexagonal base engageable with said magnetic element of said shank, each of said second plurality of screwdriver blades having a hexagonal tip, said hexagonal base of said second plurality of screwdriver blades capable of being retained in said fitting holes of said side seat.

* * * * *